US005816273A

United States Patent [19]

Milocco et al.

[11] Patent Number: 5,816,273

[45] Date of Patent: Oct. 6, 1998

[54] DISHWASHING MACHINE WITH ELECTRIC HEATING MEANS

[75] Inventors: Claudio Milocco, Trieste; Giovanni Centis, Pordenone, both of Italy

[73] Assignee: Electrolux Zanussi Elettrodomestici S.p.A., Perdenone, Italy

[21] Appl. No.: 648,918

[22] Filed: May 16, 1996

[30] Foreign Application Priority Data

May 26, 1995 [IT] Italy ..... PN950023

[51] Int. Cl.[6] ..... B08B 3/10

[52] U.S. Cl. ..... 134/108; 134/105

[58] Field of Search ..... 134/56 D, 57 D, 134/58 D, 105, 107, 108, 201

[56] References Cited

U.S. PATENT DOCUMENTS

| | | | |
|---|---|---|---|
| 2,582,103 | 1/1952 | Clegg | 134/107 |
| 2,621,666 | 12/1952 | Ornas | 134/108 |
| 3,049,450 | 8/1962 | Koons et al. | 134/105 |
| 4,326,552 | 4/1982 | Bleckmann | 134/107 |
| 5,347,610 | 9/1994 | Lee | 134/105 |
| 5,620,014 | 4/1997 | Milocco et al. | 134/108 |
| 5,660,193 | 8/1997 | Archer et al. | 134/105 |

FOREIGN PATENT DOCUMENTS

| | | | |
|---|---|---|---|
| 240003 | 9/1967 | Austria | 134/107 |

*Primary Examiner*—Frankie L. Stinson
*Attorney, Agent, or Firm*—Pearne, Gordon, McCoy & Granger LLP

[57] ABSTRACT

A dishwashing machine includes a water circulating circuit with rotating spray arms 6, 7 arranged in a washing tub 3 and supplied with water by a pump provided to recirculate water collecting in a sump 5. The water is heated by a resistance-type electric heating element 11 arranged in a casing 10. Through the surface of the casing, the heating element is in a heat exchange relationship with both the interior of the washing tub and the water collecting in said sump. The casing 10 is provided in the water circulation circuit of the dishwashing machine in a parallel arrangement with respect to the spray arms 6, 7, with an inlet 12 connected to the delivery side 14 of the pump 8, and with an outlet 13 communicating with the interior of the washing tub 3.

5 Claims, 2 Drawing Sheets

DISHWASHING MACHINE WITH ELECTRIC HEATING MEANS

BACKGROUND OF THE INVENTION

The present invention refers to a dishwashing machine provided with improved electric means for heating up the working medium.

U.S. patent application Ser. No. 08/581,326 filed on Dec. 29, 1995 by the same applicant and incorporated herein by reference, describes a dishwashing machine comprising a washing water circulation circuit provided with at least one rotating spray arm arranged in a washing tub, or tank, and adapted to be supplied by a pump used to re-circulate the water that collects in a sump provided on the bottom of the washing tub. The water is heated up by a resistance-type electric heating element housed in a casing that is part of the washing water circulation circuit. Through the surface of this casing, the resistance-type electric heating element is in a heat-exchange relation with the interior of the washing tub and the water collecting in said sump.

This arrangement enables the working medium of the machine to be heated up in a simple and effective manner in view of carrying out both the washing and the final drying of the washload. Furthermore, the resistance-type electric heating element can be conveniently reached for possible maintenance or replacement requirements. The casing that houses such a heating element is connected in series in said washing water circulation circuit, so that its sizing is dependent on and constrained by the actual water flow rate required to effectively wet the washload. Furthermore, such a connection in series with the water circulation circuit unavoidably causes undesirable pressure losses in said washing water circulation circuit.

SUMMARY OF THE INVENTION

It is therefore a main purpose of the present invention to provide a dishwashing machine that not only is provided with simple, effective and conveniently accessible electric means for heating up the working medium, but also comprises a washing water circulation circuit capable of minimizing possible pressure losses.

A further purpose of the present invention is to provide a dishwashing machine of the type mentioned above, in which the sizing of the casing provided to house the electric heating means for the working medium is substantially independent of the sizing of the remaining part of said washing water circulation circuit.

According to the invention, these and other aims are reached in a dishwashing machine provided with electric heating means and embodying the characteristics as recited in the appended claims.

BRIEF DESCRIPTION OF THE DRAWINGS

The characteristics and the advantages of the present invention will be understood from the description given below by way of non-limiting example with reference to the accompanying drawings, in which.

DETAILED DESCRIPTION OF THE PREFERRED EMBODIMENTS

Figure 1:
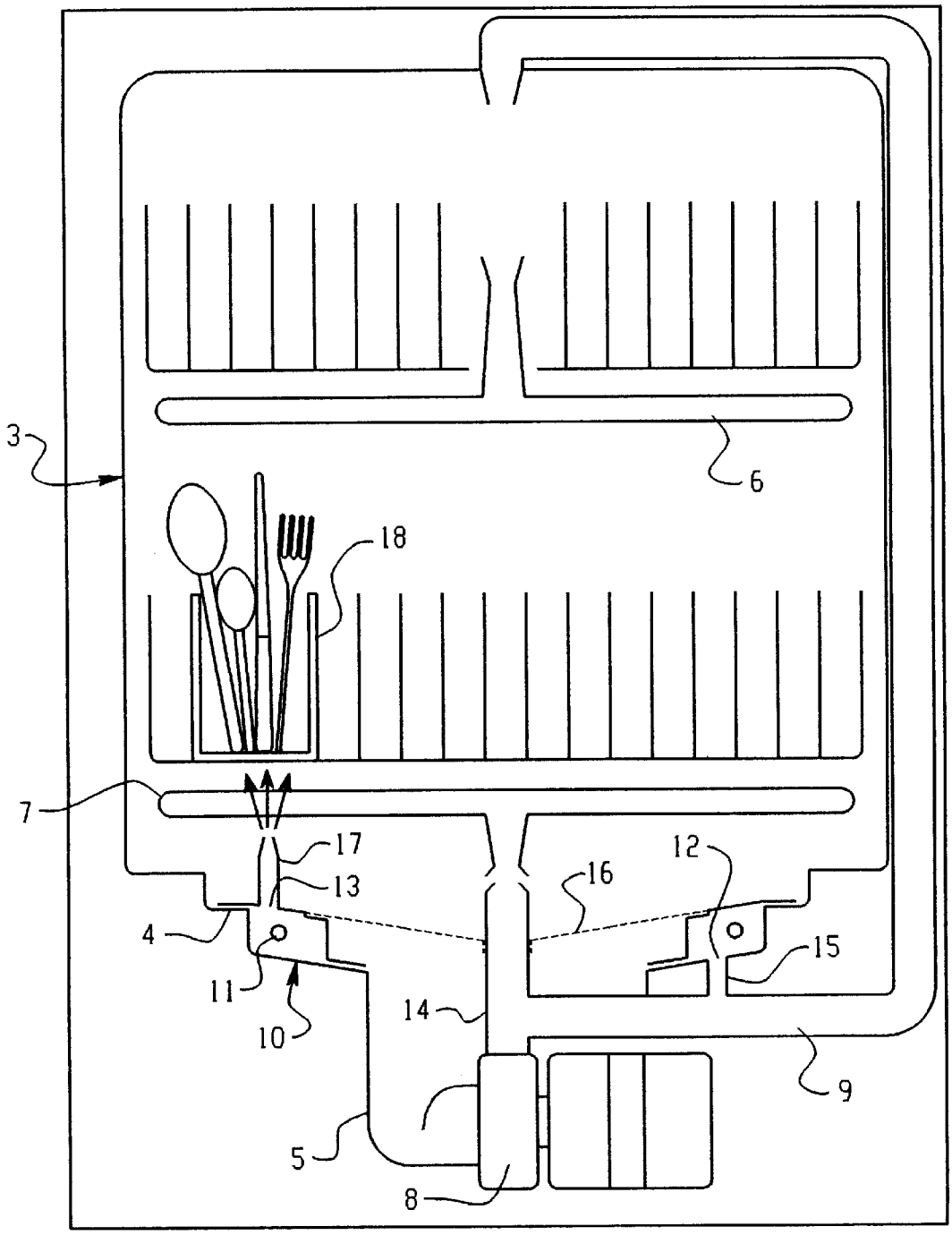
FIG. 1 is a schematical view of a dishwashing machine according to a first embodiment of the present invention.

With reference to FIG. 1, the washing water circulation circuit of the dishwashing machine comprises mainly a washing tub 3, which is provided with a bottom portion 4 that blends in its lower portion into a water collection sump 5. The washing tub is arranged to preferably accommodate an upper rotating spray arm 6 and a lower rotating spray arm 7 which are adapted to be supplied by a recirculation pump 8 so as to be able to spray the water against the washload items. The water then falls back by gravity onto the bottom 4 of the tub and through a filter 16 to finally collect into the sump 5. Specifically, the delivery side 14 of the pump 8 is connected to the upper rotating spray arm 6 through a delivery conduit 9. The lower rotating spray arm 7 is connected to the delivery side 14 of the pump 8 through a conduit comprising a traditional rotary hydraulic joint.

Electric means for heating up the working medium, such as a resistance-type electric heating element 11, is housed in a casing 10 that is included in the washing water circulation circuit of the dishwashing machine in the manner described below. The resistance-type heating element 11 is controlled by the program sequence control switch of the machine so as to appropriately heat up the water flowing through said casing 10.

In a preferred manner, the casing 10 has a hermetically sealed, metal construction, and is arranged inside the washing tub 3 in such a manner that, through at least a part of its surface, the heating element 11 is in a heat-exchange relationship with the interior of the washing tub, in particular with the water that falls back and collects into the sump 5.

As described in the afore cited U.S. patent application Ser. No. 08/581,326, the casing 10 is preferably situated in correspondence of the bottom 4 of the washing tub and preferably has a substantially annular shape arranged horizontally, with an inlet 12 and an outlet 13 which preferably are diametrically opposed to each other. The heating element 11 is shaped correspondingly, with a structure extending by an angle of almost 360° inside the casing 10, so as to optimize the heat-exchange effect.

According to the present invention, the casing 10 is arranged in the washing water circulation circuit of the dishwashing machine in parallel with the rotating spray arms 6 and 7, the inlet 12 being connected to the delivery side 14 of the circulation pump 8, and the outlet 13 communicating with the interior of the washing tub 3 and, as a result, the water collection sump 5 through the filter 16.

During operation of the machine, respective proportions of the water circulated by the pump 8 supply the rotating spray arms 6 and/or 7, respectively, as well as the casing 10. In particular, the water flowing through the casing 10 is heated up directly by the heating element 11 before flowing back into the collection sump 5. The water flows supplying the rotating spray arms 6, 7 do not suffer any loss of pressure in the circuit since they are not required to flow across the casing 10.

The casing 10 can be advantageously sized in a manner which is by no way subordinate to the flow rate that must be ensured by the conduits supplying the rotating spray arms 6, 7. In all cases, the water flow passing through the casing 10 is heated up directly by the heating element 11 and helps in heating up the whole volume of water that collects in the sump 5. Furthermore, the water that falls back in the tub toward the sump 5 is heated up indirectly by the heating element 11 through the walls of the casing 10.

In a preferred manner, the inlet 12 of the casing 10 is connected to the delivery 14 of the pump through a branch 15 of the conduit 9 supplying the upper rotating spray arm 6.

In any case, the casing 10 accommodating the heating element 11 is constantly in a condition in which it is being substantially "cooled down" by water and, as a result, meeting safety requirements. Furthermore, through the casing 10 the heating element 11 is capable of performing traditional hot-air washload drying operations, without any problem of bad smell generation or overheating.

In the embodiment illustrated in FIG. 1, the outlet 13 of the casing comprises at least one nozzle 17 arranged to direct the water flowing out from the casing toward a cutlery holding basket 18, or another ware container provided in a known manner in the washing tub of the machine. The temperature of the water jet flowing out from the nozzle 17 is substantially higher than the average temperature of the water in the washing tub 3, so that the cutlery arranged in the basket 18 will be subject to an advantageously intensive cleaning action.

Figure 2:
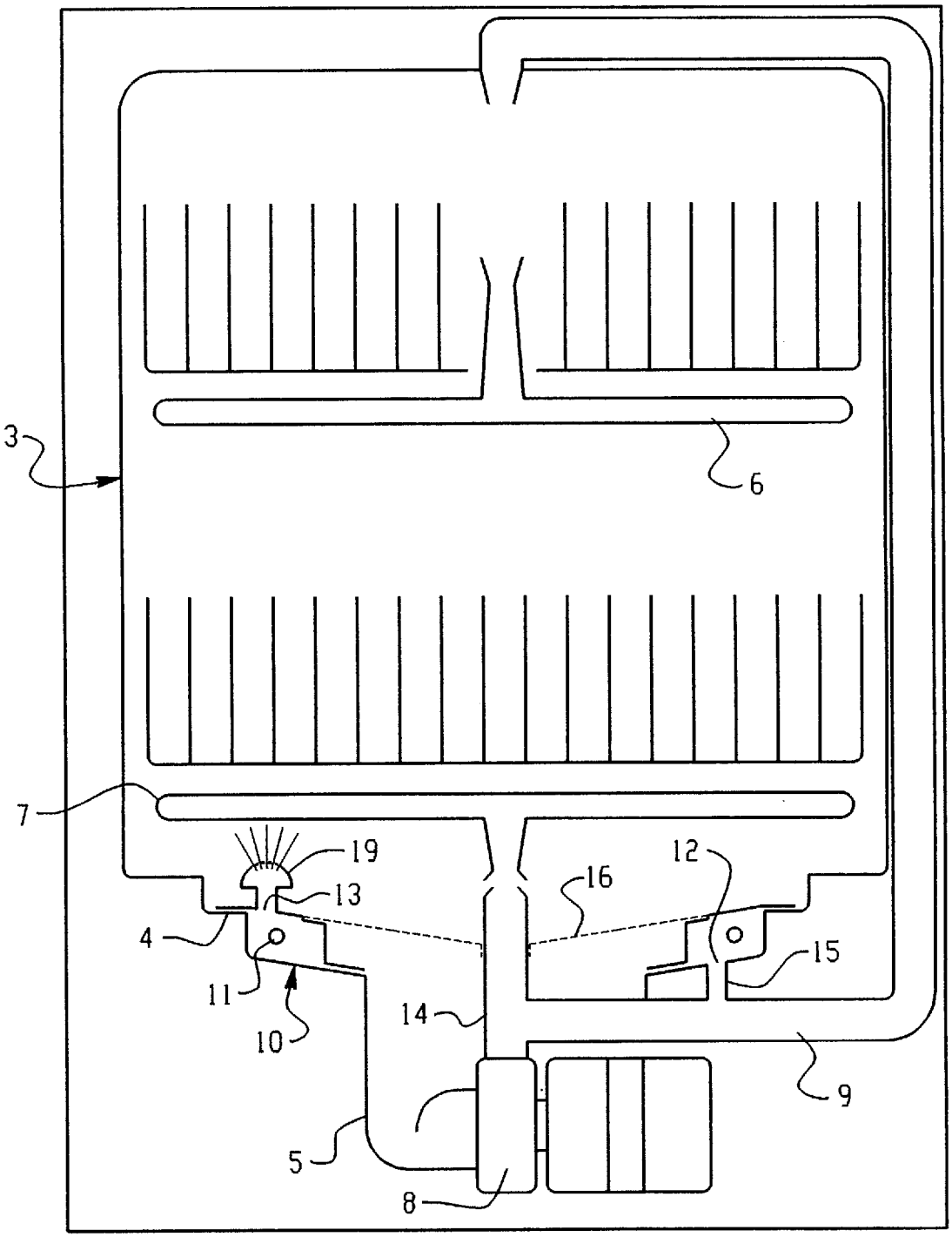
FIG. 2 is a schematical view of a second embodiment of the dishwashing machine according to the present invention.

In the variant illustrated in FIG. 2, a second filter 19 having meshes that are finer than the ones of the first filter 16 is provided at the outlet 13 of the casing 10 so that the water can be filtered in an advantageously effective manner throughout the washing cycle.

It will, of course, be appreciated that the above described dishwashing machine can be subject to a number of modifications without departing from the scope of the present invention.

For instance, the second filter 19 can be installed at the outlet 13 in such a manner as to be conveniently removable for cleaning and periodic maintenance. Furthermore, the second filter 19 may be made as a single piece with the first filter 16, in the form of an extension thereof.

What is claimed is:

1. A dishwashing machine comprising: a washing tub having a sump in the bottom of the tub for collecting washing water; at least one rotating spray arm arranged in the tub; a circulation pump for supplying water collecting in the sump to the spray arm through a water circulation circuit; electric heating means for heating the water; and at least one substantially sealed casing housing the heating means, said casing being a part of the water circulation circuit and arranged within the washing tub such that said heating means is in heat-exchange relationship with the interior of the washing tub and the water collecting in the sump through at least a part of a surface of the casing, characterized in that said casing 10 is arranged in the washing water circulation circuit of the machine in parallel with said rotating spray arm 6, 7, an inlet of the casing 12 being connected to a delivery side 14 of the circulation pump 8, and an outlet 13 of the casing communicating with the interior of the washing tub 3 and, therefore, with the water collecting sump 5.

2. A dishwashing machine according to claim 1, characterized in that the outlet 13 of the casing 10 comprises at least one nozzle 17 adapted to direct water flowing out from the casing toward a cutlery holding basket 18 situated in the washing tub.

3. A dishwashing machine according to claim 1, characterized in that there is provided a close-mesh filter 19 in correspondence of the outlet 13 of said casing 10.

4. A dishwashing machine according to claim 3, characterized in that said close-mesh filter 19 is installed at said outlet 13 in a removable manner.

5. A dishwashing machine according to claim 3, characterized in that said close-mesh filter 19 is made as a single-piece construction with a filter 16 provided between the washing tub 3 and the water collecting sump 5.

* * * * *

UNITED STATES PATENT AND TRADEMARK OFFICE

CERTIFICATE OF CORRECTION

PATENT NO. : 5,816,273

DATED : October 6, 1998

INVENTOR(S) : Claudio Milocco, et. al.

It is certified that error appears in the above-identified patent and that said Letters Patent is hereby corrected as shown below:

Title page, item [56], Foreign Patent Documents, delete "9/1967" and insert --9/1964

Signed and Sealed this

Twenty-fourth Day of August, 1999

*Attest:*

Q. TODD DICKINSON

*Attesting Officer*

*Acting Commissioner of Patents and Trademarks*